US005480002A

United States Patent [19]

Kerr

[11] Patent Number: 5,480,002

[45] Date of Patent: Jan. 2, 1996

[54] DUAL TRACK MOUNTED LADDER SYSTEM

[75] Inventor: James F. Kerr, 2705 E. Hall Rd., Croswell, Mich. 48422

[73] Assignee: James F. Kerr, Croswell, Mich.

[21] Appl. No.: 354,603

[22] Filed: Dec. 13, 1994

Related U.S. Application Data

[63] Continuation-in-part of Ser. No. 298,531, Aug. 29, 1994, Pat. No. 5,413,191, which is a continuation of Ser. No. 204,105, Mar. 1, 1994, abandoned, which is a continuation of Ser. No. 63,409, May 18, 1993, abandoned.

[51] Int. Cl.[6] ..... E06C 7/00

[52] U.S. Cl. ..... 182/38; 182/39; 182/115

[58] Field of Search ..... 182/36–39, 115, 182/83, 84, 85

[56] References Cited

U.S. PATENT DOCUMENTS

| | | | |
|---|---|---|---|
| 356,375 | 1/1887 | Perkins . | |
| 470,374 | 3/1892 | Fisher . | |
| 528,824 | 11/1894 | Sumner . | |
| 862,622 | 8/1907 | Eller | 182/38 |
| 907,401 | 11/1908 | Prouty . | |
| 938,016 | 10/1909 | Niblaek | 182/39 X |
| 1,320,740 | 11/1919 | Coghlin . | |
| 1,341,996 | 6/1920 | Plucienski . | |
| 3,735,838 | 5/1973 | Greenleaf | 182/39 X |
| 5,148,889 | 9/1992 | Fenwick et al. . | |

FOREIGN PATENT DOCUMENTS 832727 10/1938 France .

OTHER PUBLICATIONS

Storage Wall System (Lista), Catalog Sw–255.
Rolling Wood Ladders (Cotterman), Bulletin WL–188.

*Primary Examiner*—Alvin C. Chin-Shue
*Attorney, Agent, or Firm*—Dykema Gossett

[57] ABSTRACT

The ladder system is located adjacent the front face of a storage rack. The ladder is carried by a cantilever supported carriage assembly. The ladder may move longitudinally along the front face of the storage rack and may also be moved laterally in a direction extending perpendicular to the front face of the storage rack. The carriage assembly includes a horizontal ladder support track upon which the ladder is mounted by means of two sets of rollers. With such a construction, the ladder may pivot about the support track to avoid obstructions in the aisle or projecting from the storage rack. In this way, a user can quickly and easily position the ladder at any position along the storage rack for accessing items stored on the shelves. This ladder system is particularly useful in crowded warehouse-type retail outlets which are now in popular use across the United States of America.

20 Claims, 3 Drawing Sheets

DUAL TRACK MOUNTED LADDER SYSTEM

CROSS REFERENCE TO RELATED APPLICATIONS

This application is a continuation-in-part application of patent application, Ser. No. 08/298,531, filed Aug. 29, 1994, U.S. Pat. No. 5,413,191 issued May 9,1995, entitled "DUAL TRACK LADDER", which is a continuation of patent application, Ser. No. 08/204,105, filed Mar. 1, 1994, now abandoned, and which in turn is a continuation of patent application, Ser. No. 08/063,409, filed May 18, 1993, now abandoned.

BACKGROUND OF THE INVENTION

1. Field of the Invention

The ladder system is designed to be used in large retail stores and warehouses where storage shelves are located one on top of the other along the walls and the aisles where products and merchandise are stored. The storage room shelves may be anywhere from fifteen to twenty feet in height, sometimes even higher. When employees or workers remove large, sometime bulky packages from the shelves unassisted using only a ladder, such employees can fall thereby injuring themselves. This results in not only lost time for the employees but also the company may be responsible for the workers' injuries.

2. Description of the Prior Art

One way of obtaining a package off from an overhead shelf is shown in U.S. Pat. No. 2,894,641, where a worker must carry a heavy platform to the desired site, then use a separate ladder to get to the platform. Thus, the employee has to incur the risk of having the ladder, platform or both slip while climbing, and once on the platform, the employee still has to climb down the ladder carrying the heavy package. Another prior art ladder is mounted on rollers for movement along the aisle while this type of ladder has benefits in some applications, if there are obstructive items stored on the floor of the aisle, the ladder may not always be able to pass around the obstructive items. The "library-type" ladder is also known in the prior art and is mounted for movement longitudinally along the storage racks or shelves. If obstructive items are in the way of the ladder, the ladder may not be able to move around the obstructive items.

SUMMARY OF THE INVENTION

It is a feature of the present invention to provide a ladder system for a storage rack or racking. The system incorporates the concept of two tracks, one track being provided at the top of the storage rack and the other track at a lower level on the same storage rack. The ladder is designed to be mounted on the upper and lower tracks and movable parallel to the front face of the racking.

A further feature of the present invention is to provide a ladder system having a cantilever mounted carriage assembly which supports the ladder and is carried by the upper and lower tracks. The upper track carries most of the load executed on the ladder while the lower track provides stability and rigidity for the ladder system.

A still further feature of the present invention is to provide a ladder system having a ladder similar to a conventional staircase including hand rails at opposite sides, with the lower end of the ladder being provided with casters and a safe-lock assembly for holding the casters of the ladder in a fixed position on the support surface.

Another feature of the present invention is to provide a ladder system of the aforementioned type wherein the ladder is provided at the top with pairs of rollers engageable with the horizontal ladder support track of the cantilever mounting carriage assembly thereby permitting the ladder to pivot and be lifted over obstructions in the aisle or projecting from the storage rack.

Still another feature of the present invention is to provide a side mounted dual track ladder assembly which permits the ladder to move outward at right angles to the storage rack in addition to rolling parallel to the rack. With such a construction, the ladder is mounted on a track provided on the cantilever mount carriage assembly which is carried by the upper and lower tracks. This permits the ladder to move around obstructions in the aisle or on the rack.

A further feature of the present invention is to provide a safe, cost effective way of obtaining packages from overhead areas without causing injury to the workers or employees.

A still further feature of the present invention is to provide a ladder system wherein an elevated platform is connected to the upper end of the ladder at a location which permits the user to have access to the space of the storage rack between the upper and lower tracks.

Another further feature of the present invention is to provide a ladder system of the aforementioned type wherein the ladder is carried by the upper and lower tracks at a angle to the support surface of between 50 and 65 degrees.

DETAILED DESCRIPTION OF THE PREFERRED EMBODIMENT

Figure 1:
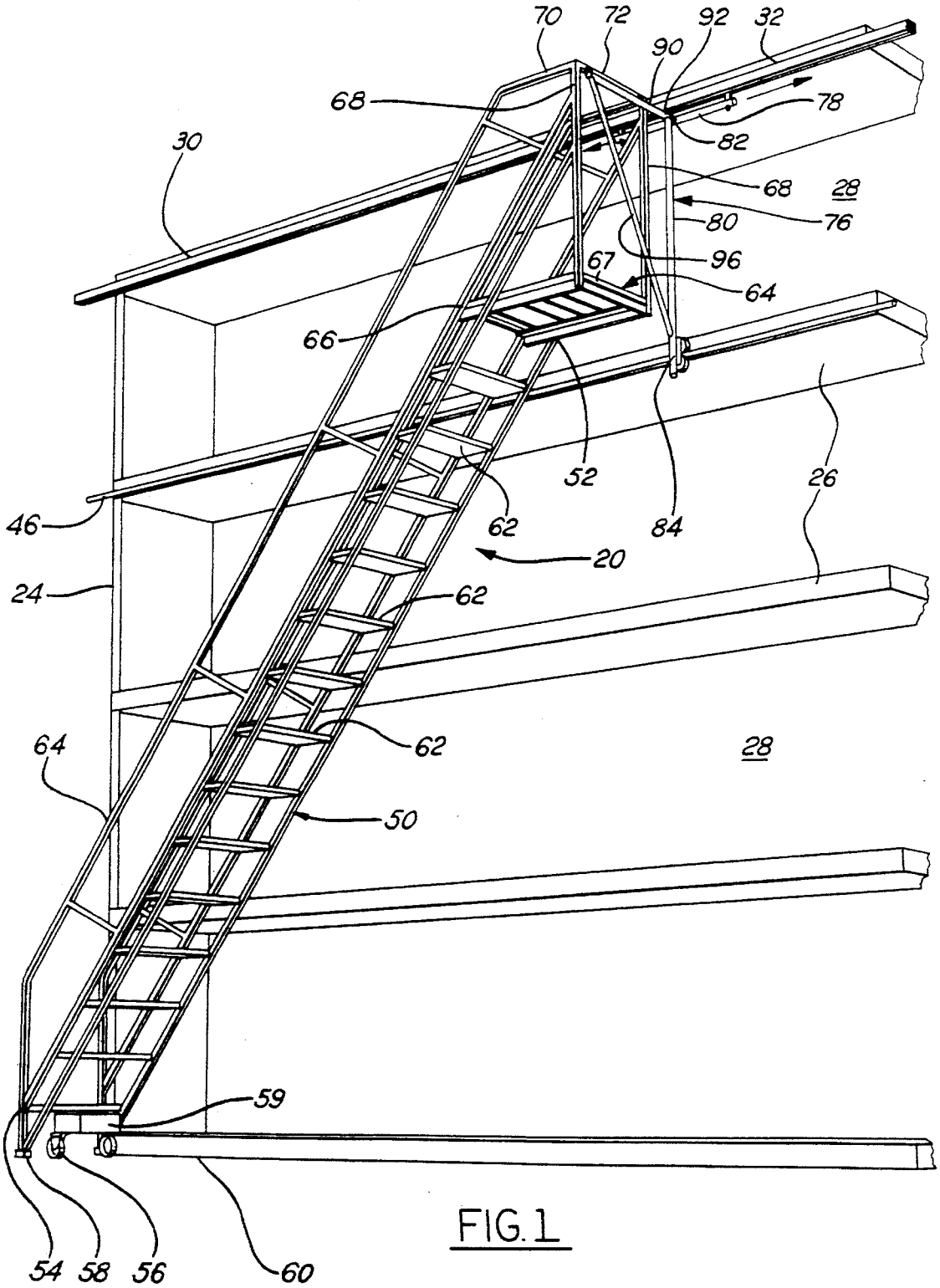
FIG. 1 is a perspective view of the ladder system mounted on the front face of a storage rack.

FIG. 1 illustrates a ladder system 20 mounted on a shelving unit 24 at one side of an aisle of large commercial retail stores and outlets. The ladder system 20 of the present invention is designed to be mounted on shelving units having a height between 10 and 20 feet or higher as is now common in retail outlets and warehouses. The shelving 24 may contain any number of shelves 26 where packages, goods and other items may be stored. The ladder system 20 is designed to permit a person or user of the system to have access to the packages or goods stored within the storage spaces 28 provided between the shelves 26. The storage unit 24 has a front face 30 lying in a vertical plane. Adjacent the front face 30 is a structural track support including a pair of horizontal beams 33 and 35 projecting outwardly from the shelving 24.

Figure 6:
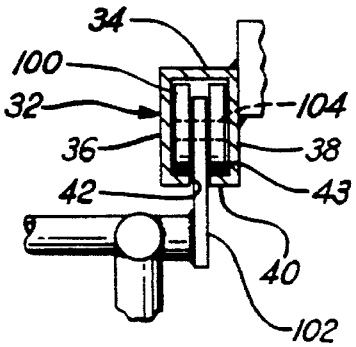
FIG. 6 is a fragmentary sectional view of the upper track, taken on the line 6—6 of FIG. 5 and showing the manner in which the upper rollers are carried by the upper track to support the cantilever mounted carriage assembly.

An upper track 32 is secured by welding to support beam 33. The upper track 32 is of generally rectangular tubular configuration (FIG. 6) including a top wall 34, side walls 36 and 38 and a bottom wall 40 provided with a longitudinal slot 42 which extends from one end of the track 32 to the other end. Thus, the bottom wall 40 is divided into a pair of bearing surfaces 43 located on opposite sides of the longitudinal slot 42.

The ladder system 20 further includes a lower track 46 of circular outer cross-section throughout its length. The lower track 46 is spaced vertically from the track 30 and is secured to the support beam 35 by appropriate means such as welding or suitable mechanical fasteners.

The ladder system 20 further includes a ladder 50 having an upper end 52 and a lower end 54. The ladder 50 is provided with suitable casters or wheels 56 and a pair of rubber bumpers 58 for supporting the lower end of the ladder on the support surface 60 as shown in FIG. 1. A safe-lock assembly 59 is provided adjacent the casters 56 to lock the casters or wheels when the ladder is being used. The ladder 50 is provided with a series of vertically spaced steps 62. Suitable handrails 64 are provided on opposite sides of the ladder 50 and extend from the lower end 54, as best shown in FIG. 1, to the upper end 52.

A platform 64 is provided at the upper end 52 of the ladder 50. The platform 64 is appropriately connected to opposite sides of the ladder 50 at 66, with the front edge 67 of the platform 64 being connected by a pair of vertical struts 68 to the handrail extensions 70 and 72 as illustrated in FIG. 1.

The ladder system 20 further includes a cantilever mounted carriage assembly 76 to which the ladder 50 is connected. Assembly 76 includes a horizontal arm 78 extending parallel to the upper track 32 and a vertical arm 80 having an upper end 82 and a lower end 84. The upper end 82 of the vertical arm 80 is connected by welding, as an example, to the horizontal arm 78 midway between the ends thereof as best shown in FIG. 4.

Figure 4:
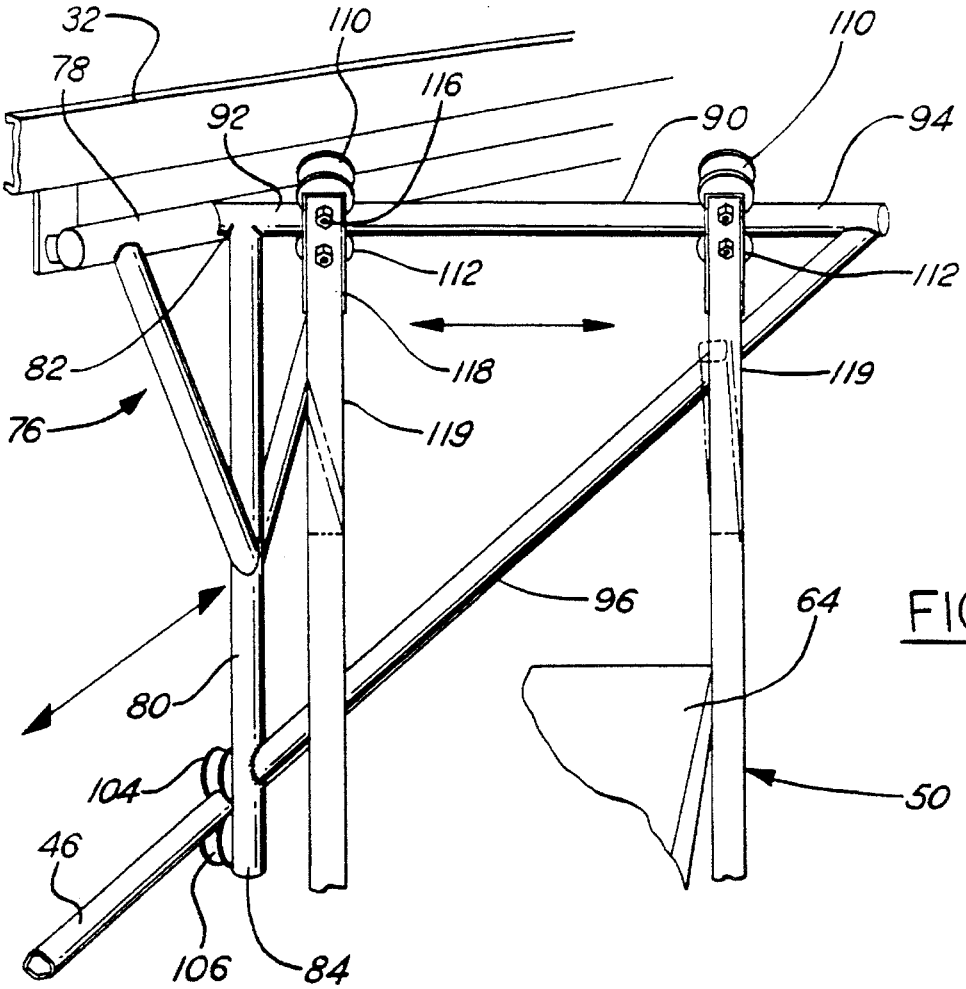
FIG. 4 is a fragmentary perspective view of the cantilever mounted carriage assembly, showing the manner in which the ladder is carried by the horizontal ladder support track.
Figure 5:
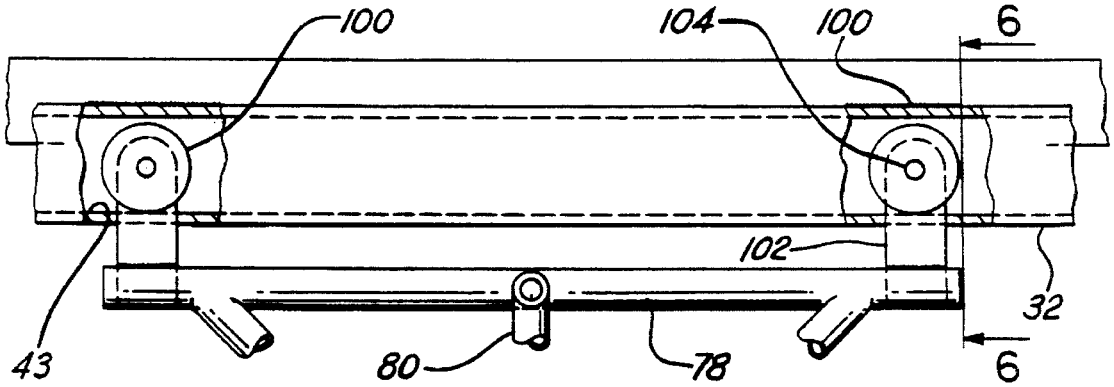
FIG. 5 is a fragmentary elevational view, with parts broken away, showing the mounting of the cantilever mounted carriage assembly to the upper track of the ladder system.

The cantilever mounted carriage assembly 76 further includes a horizontal ladder support track 90 having the inner end 92 secured to the horizontal arm 78 and the vertical arm 80 where the last mentioned arms intersect as shown in FIG. 4. The outer end 94 of the horizontal ladder support track 90 is connected to the vertical arm 80 near the end 84 by a cross-strut or brace 96. The arms 78, 80, track 90 and brace 96 are made from tubular metal pipes or from solid metal stock and are connected together as previously described by welding.

The cantilever mounted carriage assembly 76 is carried by the upper track 30 and the lower track 46. Specifically, the opposing ends of the horizontal arm 78 are each provided with a pair of rollers or bearings 100. Each pair of bearings 100 is carried by a roller bracket or strap 102. The rollers 100 are journaled to the bracket 102 by an axle or pin 104. The roller bearings and bracket assembly moves on the bearing surfaces 43 defined by the bottom wall 40 when the ladder 50 is moved in a longitudinal direction A (FIG. 2) which is defined as extending parallel to the front face 30 of the storage rack 24 or shelving. The brackets 102 move through the slot 42 as the rollers 100 traverse the bearing surfaces 43.

Figure 2:
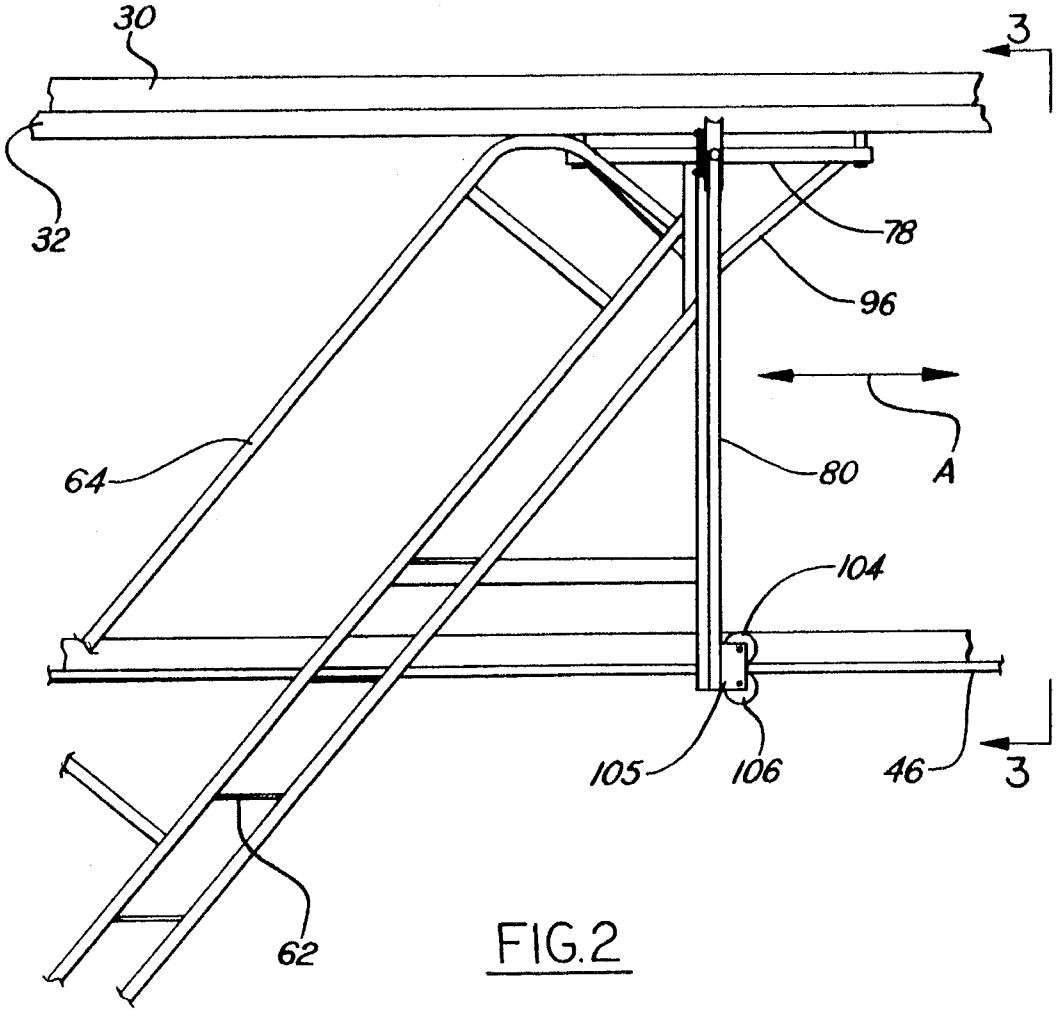
FIG. 2 is a fragmentary elevational view of the ladder system showing the attachment of the ladder and the cantilever mounted carriage assembly to the upper and lower tracks.

The lower end 84 of the vertical arm 80 of the cantilever mounted carriage assembly 76 is provided with a pair of vertically spaced rollers 104 and 106. The rollers are mounted on a bracket 105 secured to arm 80 as shown in FIG. 2. The lower track 46 is of arcuate, circular, or curved cross-section corresponding to the curvature of the rollers 104 and 106 as best shown in FIG. 4.

When the ladder 50 is moved in the longitudinal direction A, which extends parallel to the front face of the storage rack 24, the upper rollers 100 move along the bearing surfaces 43 defined by the bottom wall 40 of the upper track 32. The upper rollers or bearings 100 at opposite ends of the horizontal arm 78 support most of the load placed upon the ladder system 20. The vertically spaced rollers 104 and 106 carried by the vertical arm 80 are generally not load bearing rollers and are provided to provide stability and rigidity for the cantilever mounted carriage assembly 76 and for the ladder 50.

Figure 3:
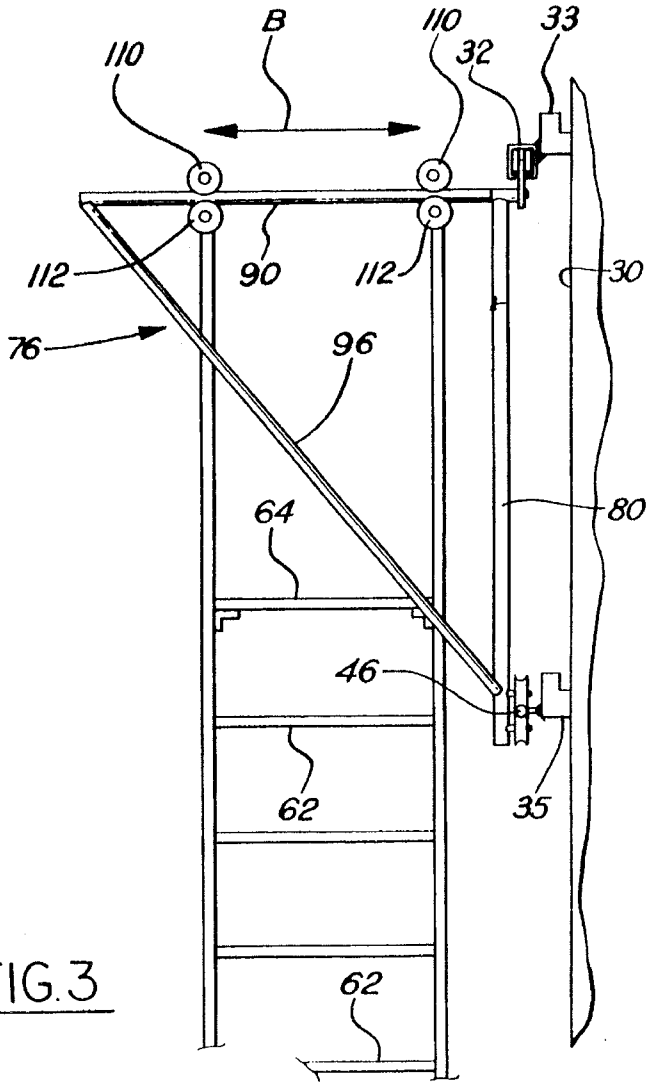
FIG. 3 is a fragmentary end view of the ladder system taken on the line 3—3 of FIG. 2 and illustrating the manner in which the upper end of the ladder is mounted on the horizontal ladder support track of the cantilever mounted carriage assembly which is in turn carried by the upper and lower tracks.

The present invention further includes a feature which permits the ladder 50 to move outward in a lateral direction B (FIG. 3) at right angles to the storage rack 42 in addition to rolling parallel to the racking or storage rack 24 as previously described. The top of the ladder 50 is provided with a pair of transversely spaced upper and lower rollers 110 and 112 which are arranged in sets. A set of upper and lower rollers 110, 112 are appropriately connected to the ladder 50 by suitable hardware including threaded fasteners 116 and mounting brackets 118 secured to the ladder posts 119. The rollers 110, 112 are designed to roll along the horizontal ladder support track 90. The rollers 110, 112 are of curved configuration matching the curved configuration of the corresponding track 90. With such a construction, a person may take hold of the ladder 50 and rotate the ladder 50 about the rollers 110, 112 to permit the ladder to be moved around obstructions in the aisle or to avoid obstructions projecting from the storage rack 24.

A particular ladder has been illustrated in the drawings. It should be understood that other types of ladders may incorporate the inventive features. As an example, a ladder could be employed which does not have a platform 64 but yet the ladder is mounted on the carriage assembly for movement in a longitudinal direction A as well as in a lateral direction B which extends perpendicular to the front face of the storage rack. Moreover, the ladder may be metal, wood or another other appropriate material.

The ladder system is designed for storage racks having a height of ten to twenty feet or higher. The ladder is counted at an angle C of 50° to 65° (FIG. 1) thereby providing an easy climbing angle as in a standard stairway.

A preferred embodiment of the present invention has been disclosed. However, a worker of ordinary skill in the art would recognize that certain modifications would come within the scope of this invention. For that reason, the following claims should be studied in order to determine the scope and content of this invention.

What I claim is:

1. A ladder system for positioning a ladder relative to a storage rack having a front face and located at one side of an aisle, a longitudinal direction being defined as extending parallel to the front face of the storage rack and a lateral direction being defined as extending perpendicular to the front face of the storage rack, the ladder system comprising:

a ladder having upper and lower ends, with the lower end being engageable with a horizontal support surface;

an upper track located near the front face of the storage rack;

a lower track vertically spaced from said upper track and located near the front face of the storage rack;

a cantilever mounted carriage assembly having a horizontal arm extending parallel to said upper track, a vertical arm connected to and depending from said horizontal arm and a horizontal ladder support track connected to said horizontal and vertical arms and extending in a lateral direction;

said horizontal arm being provided with longitudinally spaced upper rollers engageable with said upper track and said vertical arm being provided with lower rollers engageable with said lower track, said upper and lower rollers movable along said tracks as said carriage assembly and said ladder are moved in the longitudinal direction parallel to the front face of the storage rack; and the upper end of said ladder being provided with laterally spaced rollers engageable with said horizontal ladder support track to permit said ladder to move along said support track in a lateral direction perpendicular to the front face of the storage rack.

2. The ladder system as defined in claim 1, wherein said upper rollers engageable with said upper track support most of the load placed upon said ladder system, said lower rollers attached to said vertical arm being generally non-load bearing rollers providing stability and rigidity for the ladder system.

3. The ladder system as recited in claim 1, wherein said ladder is also adapted to pivot about the rollers provided at the upper end of said ladder engageable with said horizontal ladder support track to permit the ladder to be moved around obstructions in the aisle or projecting from said storage rack.

4. The ladder system as recited in claim 1, wherein said ladder at upper end thereof is provided with an elevated platform for supporting a user as the user stores or removes an article from the storage rack.

5. The ladder system as recited in claim 4, wherein said elevated platform is carried by said ladder at a location which permits the user to have access to the space between said upper and lower tracks.

6. The ladder system as recited in claim 1, wherein the lower end of said ladder is provided with wheels engageable with the support surface and a safety lock assembly for locking the wheels in place on the support surface when the ladder system is in use.

7. The ladder system as recited in claim 1, wherein the lower end of said ladder is provided with a pair of rubber bumpers for engaging the horizontal support surface.

8. The ladder system as recited in claim 1, wherein said ladder is carried by said upper and lower tracks at an angle between 50 and 65 degrees.

9. The ladder system as recited in claim 1, wherein said ladder includes a pair of hand rails at opposite sides of the ladder, said hand rails extending from the bottom to the top of the ladder.

10. The ladder system as recited in claim 1, wherein the rollers provided on the upper end of said ladder includes a pair of spaced rollers positioned on each side of said horizontal ladder support track, said last mentioned rollers guiding said ladder for lateral and pivoting movements.

11. The ladder system as recited in claim 1, wherein said rollers provided on the upper end of said ladder have curved surfaces corresponding to the outer periphery of said horizontal ladder support track such that said rollers may pivot about said track in order to move around obstructions in the aisle or projecting from the storage rack.

12. A ladder system for positioning a ladder relative to a storage rack having a front face and located at one side of an aisle, a longitudinal direction being defined as extending parallel to the front face of the storage rack and a lateral direction being defined as extending perpendicular to the front face of the storage rack, the ladder system comprising:

a ladder having upper and lower ends, with the lower end being engageable with a horizontal support surface;

an upper track located near the front face of the storage rack;

a lower track vertically spaced from said upper track and located near the front face of the storage rack;

a cantilever mounted carriage assembly having a horizontal arm extending parallel to said upper track, a vertical arm having upper and lower ends connected on said upper end to said horizontal arm midway between the ends thereof, a horizontal ladder support track connected to said horizontal and vertical arms and extending in a lateral direction;

said horizontal arm being provided with a pair of longitudinally spaced upper rollers at opposite ends thereof which are engageable with said upper track and said vertical arm at the lower end thereof being provided with a pair of vertically spaced lower rollers engageable with opposite sides of said lower track, said upper and lower rollers being movable along said tracks as said carriage assembly and said ladder are moved in the longitudinal direction parallel to the front face of the storage rack; and the upper end of said ladder being provided with two pairs of laterally spaced rollers engageable with said horizontal ladder support track to permit said ladder to move along said support track in a lateral direction perpendicular to the front face of the storage rack.

13. The ladder system as recited in claim 12, wherein said ladder is also adapted to pivot about said two rollers provided at the upper end of said ladder engageable with said horizontal ladder support track to permit the ladder to be moved around obstructions in the aisle or projecting from said storage rack.

14. The ladder system as recited in claim 12, wherein said ladder at upper end thereof is provided with an elevated platform for supporting a user as the user stores or removes an article from the storage rack.

15. The ladder system as recited in claim 14, wherein said elevated platform is carried by said ladder at a location which permits the user to have access to the space between said upper and lower tracks.

16. The ladder system as recited in claim 12, wherein the lower end of said ladder is provided with wheels engageable with the support surface and a safety lock assembly for locking the wheels in place on the support surface when the ladder system is in use.

17. The ladder system as recited in claim 12, wherein the lower end of said ladder is provided with a pair of rubber bumpers for engaging the horizontal support surface.

18. The ladder system as recited in claim 12, wherein said ladder is carried by said upper and lower tracks at an angle between 50 and 65 degrees.

19. The ladder system as recited in claim 12, wherein said ladder includes a pair of hand rails at opposite sides of the ladder, said hand rails extending from the bottom to the top of said ladder.

20. The ladder system as recited in claim 12, wherein said two pairs of rollers provided on the upper end of said ladder have curved surfaces corresponding to the outer periphery of said horizontal ladder support track such that said rollers may pivot about said horizontal ladder support track in order to move around obstructions in the aisle or projecting from the storage rack.

* * * * *